US007458237B2

(12) United States Patent
Lonati et al.

(10) Patent No.: US 7,458,237 B2
(45) Date of Patent: Dec. 2, 2008

(54) METHOD FOR MANUFACTURING KNITTED ARTICLES FOR FORMING ITEMS OF CLOTHING, SUCH AS BODY SUITS, SLEEVELESS TOPS, UNDERSHIRTS, BRAS, UNDERPANTS OR THE LIKE, WITHOUT LATERAL SEAMS, WITH A CIRCULAR KNITTING MACHINE

(75) Inventors: Ettore Lonati, Brescia (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 399 days.

(21) Appl. No.: 10/561,905

(22) PCT Filed: Jun. 22, 2004

(86) PCT No.: PCT/EP2004/006730

§ 371 (c)(1),
(2), (4) Date: Dec. 21, 2005

(87) PCT Pub. No.: WO2005/010259

PCT Pub. Date: Feb. 3, 2005

(65) Prior Publication Data

US 2008/0115538 A1 May 22, 2008

(30) Foreign Application Priority Data

Jul. 3, 2003 (IT) ..... MI2003A1369

(51) Int. Cl.
*D04B 1/22* (2006.01)

(52) U.S. Cl. ..... 66/176; 66/8

(58) Field of Classification Search ..... 66/8, 66/171, 176, 177, 179, 180, 181, 182, 183, 66/185–188

See application file for complete search history.

(56) References Cited

U.S. PATENT DOCUMENTS

| | | | | |
|---|---|---|---|---|
| 2,939,303 | A * | 6/1960 | Coile et al. | 66/43 |
| 3,241,340 | A * | 3/1966 | Knohl | 66/185 |
| 3,650,126 | A | 3/1972 | Luchi | |
| 5,170,646 | A * | 12/1992 | Gariboldi | 66/51 |
| 6,460,380 | B1 * | 10/2002 | Sciacca et al. | 66/21 |
| 6,993,940 | B2 * | 2/2006 | Rabinowicz et al. | 66/176 |
| 7,328,595 | B2 * | 2/2008 | Lonati et al. | 66/176 |

* cited by examiner

*Primary Examiner*—Danny Worrell
(74) *Attorney, Agent, or Firm*—Modiano & Associati; Albert Josif; Daniel J. O'Byrne

(57) ABSTRACT

A method for manufacturing knitted articles for forming items of clothing, without lateral seams, with a circular knitting machine, comprising a step for forming at least one pouch-like region, in which part of the needles or all the needles that belong to at least one sector of the needle cylinder are moved to knit at at least one feed of the machine by way of an alternating rotary motion of the needle cylinder about its axis and with an oscillation extent sufficient to produce transit, at the feed, of all the needles of the sector that are moved to knit at the feed, in order to form, with the needles that belong to the sector and are moved to knit, a number of rows of knitting in excess with respect to the number of rows of knitting formed by the needles contiguous to the sector.

10 Claims, 3 Drawing Sheets

METHOD FOR MANUFACTURING KNITTED ARTICLES FOR FORMING ITEMS OF CLOTHING, SUCH AS BODY SUITS, SLEEVELESS TOPS, UNDERSHIRTS, BRAS, UNDERPANTS OR THE LIKE, WITHOUT LATERAL SEAMS, WITH A CIRCULAR KNITTING MACHINE

The present invention relates to a method for manufacturing knitted articles for forming items of clothing, such as body suits, sleeveless tops, undershirts, bras, underpants or the like, without lateral seams, with a circular knitting machine.

BACKGROUND OF THE INVENTION

As is known, in the production of knitted articles for forming items of clothing, particularly of the type of body suits and bras, with circular knitting machines it is necessary to form pouch-like regions, for example for forming the cups of a bra. The need to provide pouch-like regions, in order to adapt the shape of the article to its particular use or simply to achieve merely aesthetic effects, is felt also in the production of articles to be used for the production of other items of clothing, such as for example undershirts, sleeveless tops, underpants, et cetera.

Currently, pouch-like regions on tubular articles produced with circular knitting machines are obtained, in some cases, by varying the tightness of the knitting. In other cases, the pouch-like regions are obtained by making a set of needles knit at one or more feeds or drops of the machine while the other needles remain unused during the actuation of the needle cylinder with a continuous rotary motion about its own axis, so as to produce, by means of said set of needles, rows of knitting in excess with respect to the rows of knitting formed by the other needles and by necessarily cutting the thread or threads used to form these excess rows of knitting proximate to the last needle of the set of actuated needles.

In other cases, a combination of these two knitting methods is put into practice and/or highly extensible threads are used in order to enhance shaping and improve the fit of the item of clothing.

These refinements do not fully meet the various requirements, since a variation in the tightness of the knitting determines a variation of the degree of transparency of the item of clothing, while making a set of needles knit while the other needles remain inactive, by requiring cutting of the thread used to produce the excess rows, has negative effects on the degree of finish of the item of clothing and on its fit.

SUMMARY OF THE INVENTION

The aim of the present invention is to solve the above-cited problems by providing a method for manufacturing knitted articles for forming items of clothing such as body suits, sleeveless tops, undershirts, bras, underpants or the like, without lateral seams, with a circular knitting machine, which allows to obtain pouch-like regions that are fully satisfactory both from an aesthetic standpoint and as regards fit.

Within this aim, an object of the invention is to provide a method that allows to provide pouch-like regions on tubular articles without cutting the thread proximate to the perimeter of the pouch-like regions.

Another object of the invention is to provide a method that allows to produce knitted articles having pouch-like regions with the productivity that is typical of circular knitting machines.

This aim and these and other objects that will become better apparent hereinafter are achieved by a method for manufacturing knitted articles for forming items of clothing, such as body suits, sleeveless tops, undershirts, bras, underpants or the like, without lateral seams, with a circular knitting machine, characterized in that it comprises a step for forming at least one pouch-like region in which part of the needles or all the needles that belong to at least one sector of the needle cylinder are moved to knit at at least one feed of the machine by actuating the needle cylinder of the machine with an alternating rotary motion about the axis thereof and with an extent of oscillation that is sufficient to make transiting, at said at least one feed, all the needles of said at least one sector that are moved for knitting at said at least one feed, in order to form, with the needles that belong to said at least one sector and are moved for knitting, a number of rows of knitting in excess with respect to the number of rows of knitting formed by the needles that are contiguous to said at least one sector.

BRIEF DESCRIPTION OF THE DRAWINGS

Further characteristics and advantages of the invention will become better apparent from the description of a preferred but not exclusive embodiment of the method according to the invention, illustrated by way of non-limiting example in the accompanying drawings, wherein.

Figure 2:
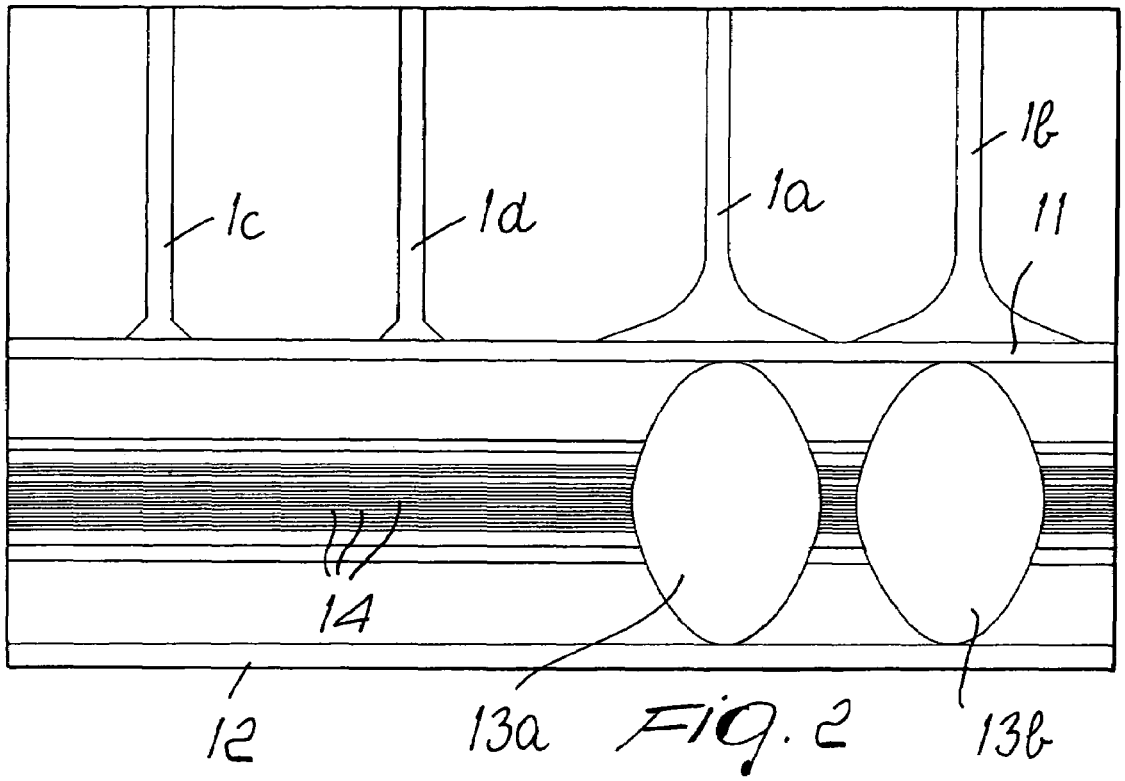
FIG. 2 is a diagram of the production of the article for forming the bra of FIG. 1.

The method according to the invention can be performed with circular knitting machines in which the needle cylinder can be actuated with a rotary motion about its own axis in both directions of rotation, for example a machine of the type described in a co-pending Patent Application by the same Applicant.

DESCRIPTION OF THE PREFERRED EMBODIMENTS

With reference to the figures, the method according to the invention comprises, during the formation of an article with a circular knitting machine of a type as indicated above, a step for forming at least one pouch-like region 13*a*, 13*b*, 23*a*, 23*b*, 25*a*, 25*b*, in which part of the needles, or all the needles, arranged in at least one sector of the needle cylinder, are moved so as to knit at at least one feed or drop of the machine by actuating the needle cylinder with an alternating rotary motion about its own axis and with an extent of oscillation that is sufficient to cause the transit, in front of said feed, of all the needles of the sector that are moved to knit, and so as to form, with said needles moved to knit, a number of rows of knitting in excess with respect to the number of rows of knitting formed by the needles that are contiguous to said sector.

The step for forming the pouch-like region or regions is preferably preceded and/or followed by a step for forming a tubular portion of knitting 11, 12, 21, 22, 24, made of rows of knitting, in which all the needles or part of the needles distributed along the entire circumferential extension of the needle cylinder are moved so as to knit at at least one feed of the machine and the needle cylinder is actuated with a continuous rotary motion about its axis.

The shape of the pouch-like region or regions 13*a*, 13*b*, 23*a*, 23*b*, 25*a*, 25*b* can be changed by varying the number of needles of the sector or sectors cited above that are moved so as to knit at the corresponding feed and/or the breadth of the sector or sectors.

The shape of the pouch-like region or regions 13*a*, 13*b*, 23*a*, 23*b*, 25*a*, 25*b* can be changed for example by gradually increasing or decreasing the number of needles of the sector that are moved so as to knit at the corresponding feed, or by first increasing and then decreasing, or vice versa, the number of needles of the sector that are made to knit at the corresponding feed, as will become better apparent hereinafter.

The shape of the pouch-like region or regions 13*a*, 13*b*, 23*a*, 23*b*, 25*a*, 25*b* can also be changed by producing, during the forming of the pouch-like region or regions, some rows of knitting 14, 24, by moving so as to knit at one or more feeds of the machine not only the needles that belong to the sector or sectors that form the excess rows of knitting for forming the pouch-like region or regions, but also all or part of the needles distributed along the entire circumferential extension of the needle cylinder.

In greater detail, with particular reference to FIGS. 1 and 2, one proceeds as follows to produce an article for forming a bra 10 with the method according to the invention.

Initially, the tabs 1*a*, 1*b*, 1*c* and 1*d* are produced by using all or part of the needles of the machine that are arranged in four sectors of the needle cylinder that are angularly spaced form each other around the axis of the needle cylinder. Each one of these sectors is correlated to a feed or drop of the machine at which all or part of the needles that belong to that given sector correlated thereto are moved so as to knit. The needle cylinder is actuated with an alternating rotary motion about its own axis with an oscillation extent that is sufficient to produce the transit, in front of a feed, of all the needles moved to knit of the sector correlated thereto. In this manner, each forward or return oscillation of the needle cylinder about its own axis forms a row of knitting of the tabs 1*a*-1*d*.

Proximate to the lateral ends of the tabs 1*a*-1*d*, knitting is formed with a selection of the needles tat must form these regions, with the needle inactive in a one-to-one configuration or with the needle in the one-to-one tuck-stitch position in order to obtain a higher knitting thickness at said regions. More particularly, in the selection with the needle in the one-to-one inactive configuration, considering a set of needles located at the ends of a corresponding sector, alternately, during the rotation in one direction of the needle cylinder, a needle of said set is deactivated and passes, with its hook, below the sinkers of the machine, while the contiguous needle is moved so as to knit at the feed being considered and forms a dropped stitch; during the rotation of the needle cylinder in the opposite direction, the needle, previously excluded from knitting, is moved so as to knit while the contiguous needle is moved so as to be inactive.

In selection with the needle in the one-to-one tuck-stitch position, considering a set of needles located at the ends of a corresponding sector, alternately, during the rotation of the needle cylinder in one direction, one needle of this set is lifted to the tuck-stitch level so as to engage the thread supplied at the feed being considered without releasing the previously formed loop, while the contiguous needle is moved so as to knit at the feed being considered and forms a dropped stitch; during the rotation of the needle cylinder in the opposite direction, the needle that previously had been raised to the tuck-stitch level is actuated so as to form a dropped stitch, while the contiguous needle is raised to the tuck-stitch level.

Proximate to the end of the formation of the tabs 1*a*-1*d*, the number of needles moved to knit for each sector and/or the breadth of the sectors can be increased so as to blend the tabs 1*a*-1*d* in with the remaining part of the article.

At the end of the formation of the tabs 1*a*-1*d*, the needle cylinder is actuated with a continuous rotary motion about its own axis, and the needles of the machine are moved so as to knit preferably at all the feeds of the machine, so as to rapidly form a tubular portion of knitting 11.

At the end of this tubular portion of knitting 11, the needles that will be excluded from knitting in the subsequent step retain the last loop of knitting in their hook and are kept lowered so that their hook lies below the knockover plane of the sinkers of the machine.

In the subsequent step, the two pouch-like regions 13*a*, 13*b* that form the cups of the bra are formed simultaneously. During this step, all or part of the needles of two sectors of the needle cylinder that are angularly spaced from each other around the axis of the needle cylinder are used, and the needle cylinder is actuated with an alternating rotary motion about its own axis. The needles that belong to one sector are moved so as to knit at one feed of the machine, while the needles that belong to the other sector are moved so as to knit at another feed of the machine. The number of needles of each sector that knit at the corresponding feed is gradually increased and then gradually decreased, so as to achieve the intended shape of the corresponding cup. The needles of the two sectors that are actuated at the two feeds produce rows of knitting in excess with respect to the other needles of the machine, thus forming the two cups of the bra.

Owing to the fact that the pouch-like regions 13*a*, 13*b* are produced by forming excess rows of knitting on some needles and reversing the rotation of the needle cylinder after the last of these needles has taken the thread at the corresponding feed, there is no need to perform thread cutting and therefore there are no unsightly trailing threads proximate to the perimeter of the pouch-like regions.

It should be noted that the shaping of the two cups of the bras can be improved, as explained above, by producing, in addition to the rows of knitting formed only with the needles that belong to said two sectors, rows of knitting formed by using all the needles of the machine or otherwise distributed along the entire circumferential extension of the needle cylinder.

Optionally, by using suitable needle selections, such as for example inactive needles or needles in the tuck-stitch position, it is possible to obtain, at the lower part of the cups or proximate to the borders of the cups or in other regions, reinforcement areas adapted to support or reinforce the breast.

After forming the cups, another tubular portion of knitting 12 is formed by using all the needles of the needle cylinder or part of said needles distributed along the entire circumferential extension of the needle cylinder and by using all or part of the feeds of the machine. This tubular portion 12, which constitutes a knitting completion border, can be produced entirely or partially as a folded double border, in a per se known manner.

The article is then disengaged from the needles and unloaded from the machine. To finish the bra, it is sufficient to join, by sewing, the ends of the tabs 1*a*, 1*d* and 1*b*, 1*c* in order to close the shoulder straps.

Figure 3:
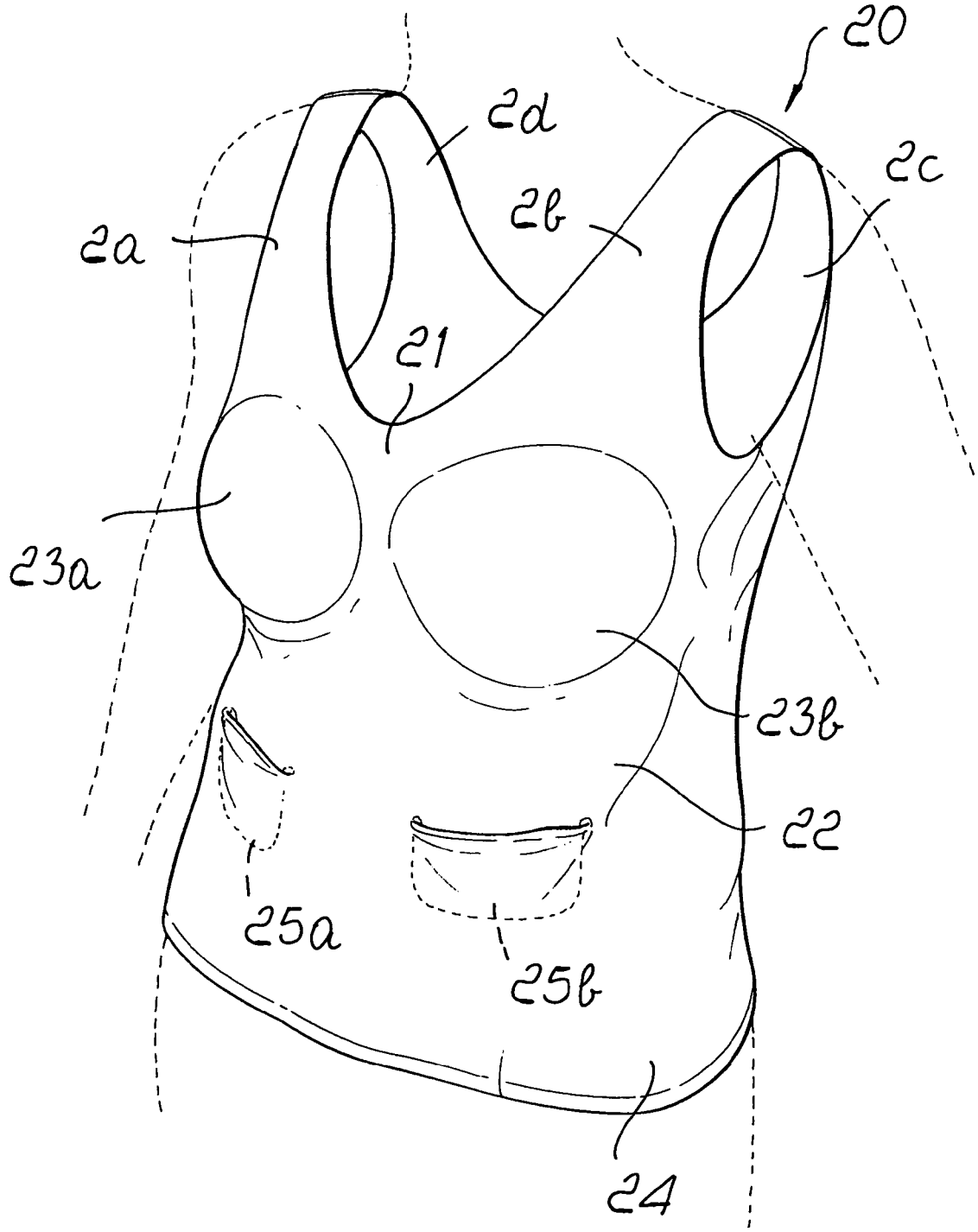
FIG. 3 is a view of an undershirt obtained with an article produced with the method according to the invention.
Figure 4:
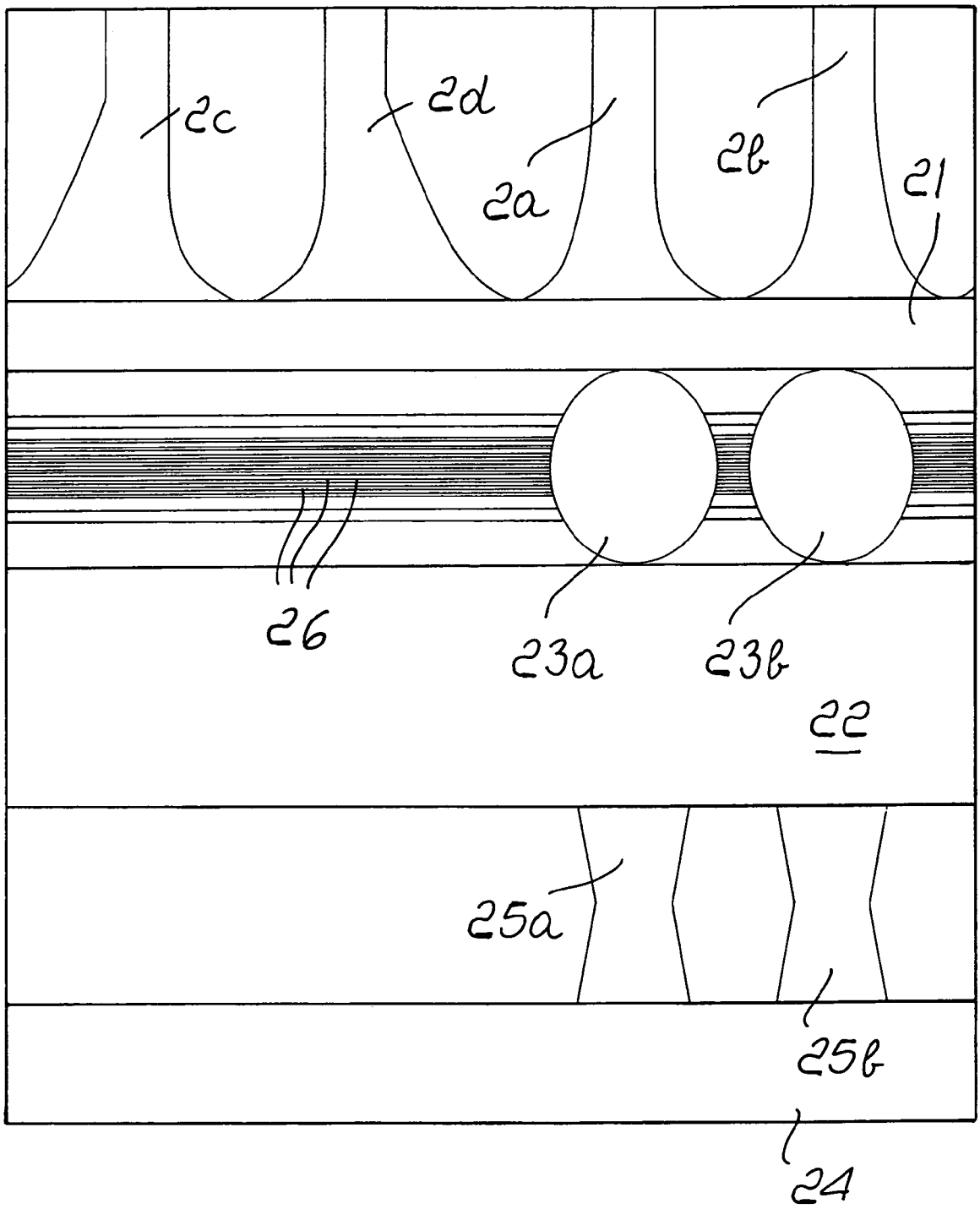
FIG. 4 is a diagram for the production of the article for forming the undershirt of FIG. 3.

With particular reference to FIGS. 3 and 4, one proceeds as follows to produce an article for forming an undershirt 20 with the method according to the invention.

Initially, the tabs 2*a*-2*d* are produced, as already described with reference to FIGS. 1 and 2. After producing the tabs 2*a*-2*d*, a first tubular portion of knitting 21 is produced by actuating the needle cylinder with a continuous rotary motion about its own axis and by moving so as to knit all the needles of the machine or part of said needles, distributed along the entire circumferential extension of the needle cylinder at all the feeds of the machine or at part of them, in a manner similar to what has been described with reference to the formation of the shoulder straps 1*a*-1*d* and the tubular portion 11 of the bra of FIGS. 1 and 2.

Figure 1:
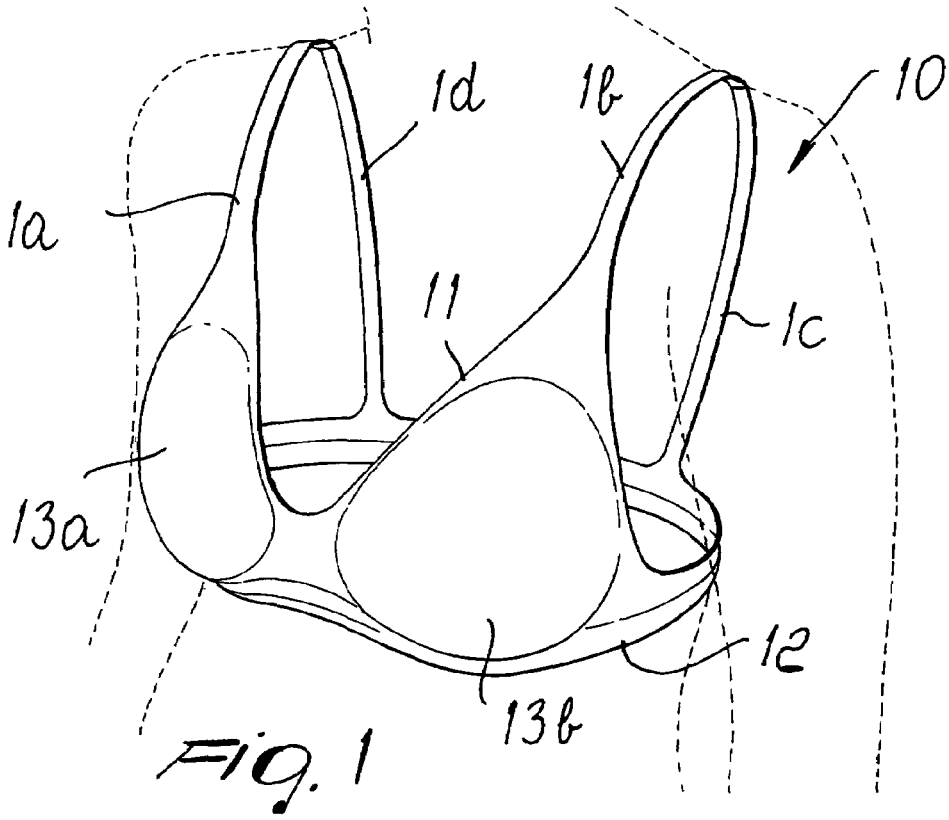
FIG. 1 is a view of a bra obtained with an article produced with the method according to the invention.

After forming the tubular portion 21, the pouch-like regions 23*a*, 23*b*, which constitute the bra cups for the undershirt, are formed in a manner similar to what has been described already with reference to FIGS. 1 and 2. In FIG. 4, the rows of knitting that correspond to the rows 14 of FIG. 2 have been designated by the reference numeral 26.

The production of pouch-like regions is not aimed exclusively at providing bra cups but can also be produced for meeting aesthetic requirements, as shown by the undershirt of FIGS. 3 and 4, in which two pouch-like regions 25*a*, 25*b* that constitute two pockets are formed. Said pockets are produced, after forming another tubular portion 22 of knitting produced like the tubular portion 21, in a manner similar to the production of the bra cups, with the difference that the number of needles of one or more sectors of the needle cylinder, depending on the number of pockets to be produced, that are moved so as to knit at the corresponding feed is gradually first decreased and then increased, retaining the last formed loop of knitting in the hook of the needles that are gradually excluded from knitting and pass with their hook below the knockover plane of the sinkers of the machine and then resume knitting when the number of active needles is increased. In this manner, the needles of the sector or sectors that are used form rows of knitting in excess with respect to the other needles of the machine, forming one or more pouches, which can be folded inwardly toward the reverse side of the article, obtaining one or more pockets.

The knitting of the article is then completed with a further tubular portion of knitting 24, which constitutes the knitting completion border. Such knitting completion border can be produced in a per se known manner as a double folded border.

The article is then disengaged from the needles and unloaded from the machine. To complete the undershirt 20, it is sufficient to join, by sewing, the ends of the tabs 2*a*, 2*d* and 2*b*, 2*c* in order to close the shoulder straps.

Depending on the type of item of clothing to be provided, all or part of the threads used to produce the article may be optionally pretensioned elastic threads.

During the knitting of the article it is possible to perform, in a per se known manner, particular types of knitting and/or patterns suitable to further improve the aesthetic appearance of the product.

In practice it has been found that the method according to the invention fully achieves the intended aim, since it allows to produce, with a circular knitting machine, articles for forming items such as body suits, sleeveless tops, undershirts, bras, underpants or the like, without lateral seams and with pouch-like regions that are fully satisfactory from an aesthetic standpoint and as regards fit.

The method thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2003A001369 from which this application claims priority are incorporated herein by reference.

What is claimed is:

1. A method for manufacturing knitted articles for forming items of clothing without lateral seams, with a circular knitting machine having needle cylinder and needles, comprising a step for forming at least one pouch-shaped region in which part of the needles or all the needles that belong to at least one sector of the needle cylinder are moved to knit at at least one feed of the machine by actuating the needle cylinder of the machine with an alternating rotary motion about an axis thereof and with an extent of oscillation that is sufficient to make transiting, at said at least one feed, all the needles of said at least one sector that are moved for knitting at said at least one feed, in order to form, with the needles that belong to said at least one sector and are moved for knitting, a number of rows of knitting in excess with respect to a number of rows of knitting formed by the needles that are contiguous to said at least one sector, wherein said step for forming at least one pouch-like region comprises the simultaneous production of at least two pouch-like regions, in which needles belonging to at least two sectors of the needle cylinder that are angularly spaced from each other around the axis of the needle cylinder are moved so as to knit at a different feed for each one of said sectors and the needle cylinder is actuated with an alternating rotary motion about its own axis with an oscillation extent that produces the transit, in front of the corresponding feed, of all the needles of the correlated sector that are moved so as to knit in order to form, with the needles that belong to said at least two sectors and are moved so as to knit at the corresponding feeds, rows of knitting in excess with respect to the rows of knitting formed, during said step for forming the pouch-like regions, by the needles that are contiguous to said at least two sectors.

2. The method of claim 1, wherein during said step for forming at least one pouch-shaped region, rows of knitting are also formed by making all or part of the needles distributed along the entire circumferential extension of the needle cylinder knit at said at least one feed.

3. The method of claim 1, wherein during said step for forming at least one pouch-shaped region a number of needles that belong to said at least one sector and are moved to knit at a corresponding feed is increased gradually.

4. The method of claim 1, wherein during said step for forming at least one pouch-shaped region a number of needles that belong to said at least one sector and are moved to knit at a corresponding feed is decreased gradually.

5. The method of claim 1, wherein during said step for forming at least one pouch-shaped region a number of needles that belong to said at least one sector and are moved so as to knit at a corresponding feed is first increased gradually and then decreased gradually.

6. The method of claim 1, wherein during said step for forming at least one pouch-shaped region a number of needles that belong to said at least one sector and are moved to knit at a corresponding feed is first decreased gradually and then increased gradually.

7. The method of claim 1, wherein during said step for forming at least one pouch-shaped region a number of needles that belong to said at least one sector and are moved to knit at a corresponding feed is first decreased gradually, retaining the last formed loop of knitting in a hook of the needles tat are gradually excluded from knitting, and is then increased gradually by resuming knitting also with needles previously gradually excluded from knitting that had retained in their hook the last formed loop of knitting.

8. The method of claim 1, wherein before said step for forming at least one pouch-shaped region, a step for forming at least one tubular portion of knitting is performed by moving so as to knit, at at least one feed or drop of the machine, all the needles or part of the needles of the needle cylinder distributed along the entire circumferential extension of the needle cylinder, and the needle cylinder is actuated with a continuous rotary motion about its own axis.

9. The method of claim 1, wherein after said step for forming at least one pouch-shaped region, a step for forming at least one tubular portion of knitting is performed by moving so as to knit, at at least one feed or drop of the machine, all the needles or part of the needles of the needle cylinder distributed along the entire circumferential extension of the needle cylinder, and the needle cylinder is actuated with a continuous rotary motion about its own axis.

10. The method of claim 9, wherein at least part of said tubular portion of knitting is produced as a double folded border.

* * * * *